United States Patent [19]

Maltais et al.

[11] Patent Number: 4,754,104

[45] Date of Patent: Jun. 28, 1988

[54] ROTARY SWITCH WITH INSULATION DISPLACEMENT CONNECTORS

[75] Inventors: Jay F. Maltais, Bensalem; Thomas J. Quigley, Holland, both of Pa.

[73] Assignee: Continental-Wirt Electronics Corporation, Southampton, Pa.

[21] Appl. No.: 71,505

[22] Filed: Jul. 9, 1987

[51] Int. Cl.[4] ..... H01H 19/54; H01H 21/76; H01H 1/00; H01R 13/38

[52] U.S. Cl. ..... 200/11 R; 200/11 G; 200/284; 439/417

[58] Field of Search ..... 200/11 R, 11 G, 11 J, 200/11 K, 11 TW, 11 A, 11 C, 11 E, 11 EA, 284, 303; 439/385, 387, 389, 391, 395, 417

[56] References Cited

U.S. PATENT DOCUMENTS

| | | | |
|---|---|---|---|
| 2,673,968 | 3/1954 | Smith | 439/417 |
| 2,813,158 | 11/1957 | Hutt | 200/6 BB |
| 3,196,237 | 7/1965 | Westgate, Jr. | 200/303 X |
| 3,748,419 | 7/1973 | Torrey | 200/284 X |
| 3,910,672 | 10/1975 | Frantz | 439/417 |
| 4,016,387 | 4/1977 | Aberer | 200/303 |
| 4,034,178 | 7/1977 | Koppenheffer et al. | 200/303 X |
| 4,045,637 | 8/1977 | Mongeau | 200/303 |

FOREIGN PATENT DOCUMENTS

| | | | |
|---|---|---|---|
| 2840277 | 3/1979 | Fed. Rep. of Germany | 439/395 |

*Primary Examiner*—J. R. Scott

*Attorney, Agent, or Firm*—Caesar, Rivise, Bernstein, Cohen & Pokotilow, Ltd.

[57] ABSTRACT

An electrical rotary switch having a housing formed of an electrically insulative material and including a plurality of fixed electrically conductive contacts therein. A rotatable contact is arranged to be rotated into a plurality of positions and includes electrically conductive means to electrically interconnect selected ones of the fixed contacts depending upon the rotational position of the contactor. A detent mechanism is located in the housing and comprises a generally planar, frame-like plate formed of a resilient material and having an opposed pair of elongated arms extending generally parallel to each other and interconnected adjacent their respective ends by cantilever arms. The cantilever arms form tapering cam surfaces which are adapted to engage diametrically opposed recesses in the rotatable contactor to establish the various rotational positions of the rotatable contactor. The decent plate is located within a recess in the housing. The housing also includes plurality of electrically conductive insulation displacement connectors electrically connected to the fixed contacts. At least one break-away block is provided in the housing and adjacent the insulation displacement connectors. The block is arranged to be displaced by a force provided thereto to cause it to break away from the housing to move into a position carrying the electrically conductive wires into the insulation displacement connectors so that electrical continuity is established therebetween. Both the block and the housing include recess portions which cooperate with each other to provide passages through which the electrical wires extend into the housing once connection is effected.

27 Claims, 3 Drawing Sheets

FIG. 2
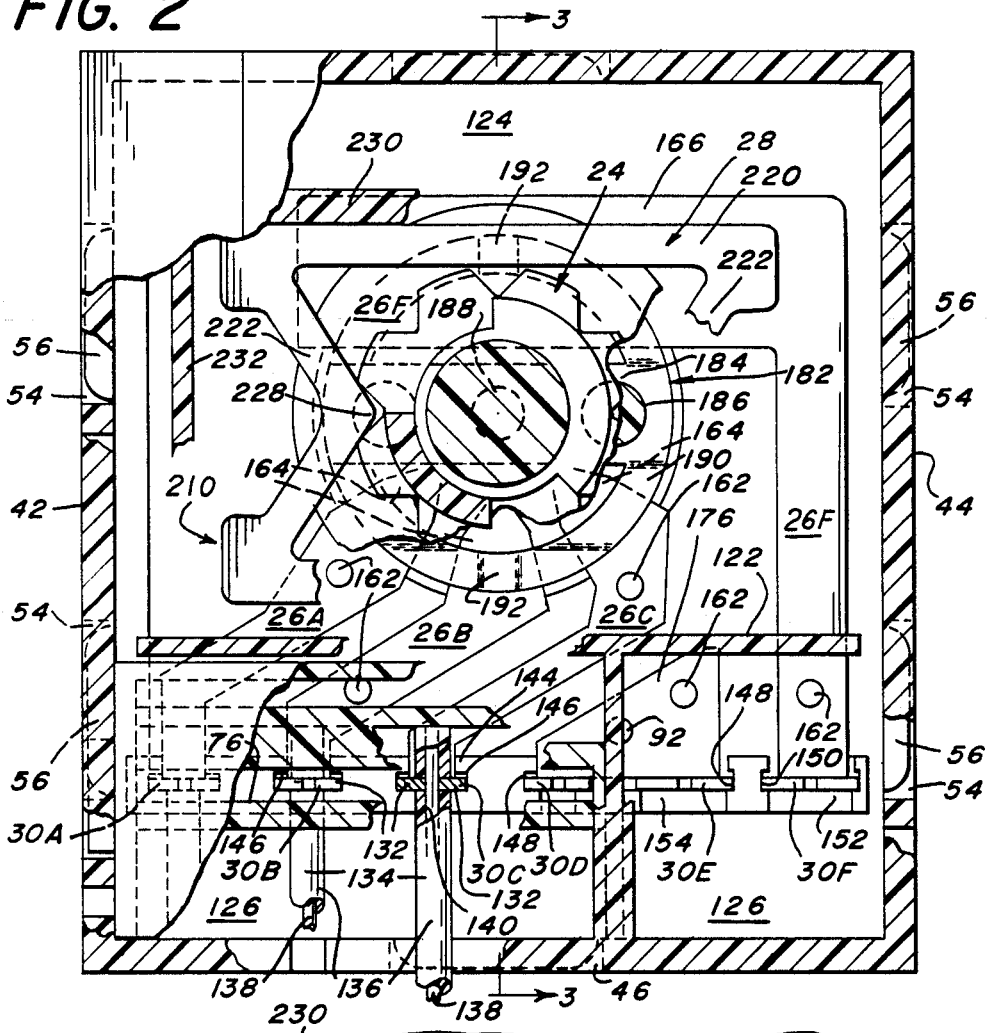
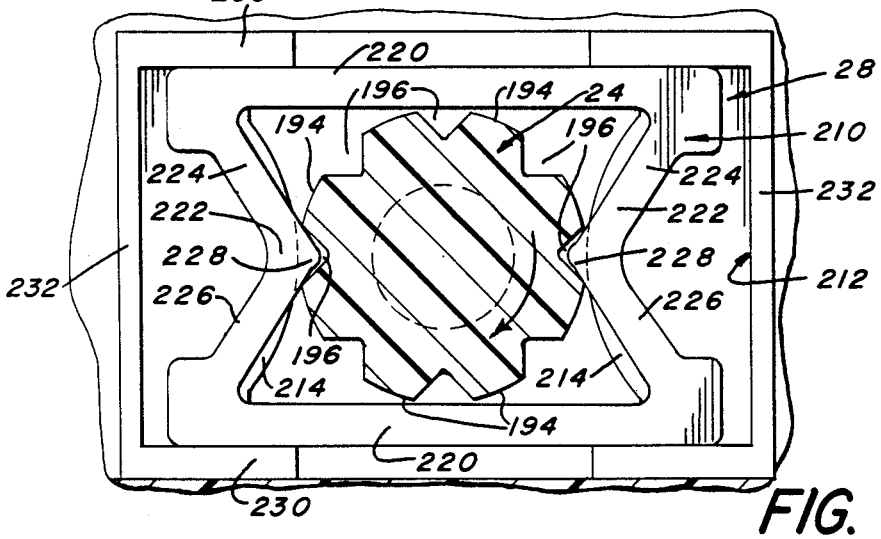
FIG. 5

ROTARY SWITCH WITH INSULATION DISPLACEMENT CONNECTORS

BACKGROUND OF THE INVENTION

This invention relates generally to electrical switches and/or electrical connectors and more particularly to electrical switches of the rotary type and having insulation displacement connectors.

Electrical switches of the rotary type are known in the art and typically comprise a housing in which a plurality of stationary or fixed electrical contacts are located. Each contact is arranged to be connected by respective electrical wires to the external circuitry to be controlled by the switch. Thus, prior art switches also include connector mechanisms, such as screws, pressure-lock connectors, etc., located within the housing and to which the wires are to be connected. Selected one(s) of the fixed contacts are arranged to be electrically engaged by a movable contactor to connect the desired wires together. The movable contactor is frequently mounted on a rotable member or rotor. The rotor typically includes a shaft-like element extending out of the housing and which is arranged to be gripped directly or through use of a knob mounted thereon to effect its rotation to select the desired contacts to be connected together. In order to ensure that the fixed contact(s) which are electrically engaged by the movable contactor remain in good electrical continuity against accidental disconnection, prior art rotary switches frequently include some type of holding (detent) mechanism. One common example of a prior art detent mechanism consists of providing a cam surface extending about the periphery of the rotor to form a plurality of alternating recesses and lobes. A spring biased member, such as a metal spring-finger (which in some cases may be a fixed contact of the switch), is mounted in the housing adjacent the rotor to slide along the rotor's cam surface as the rotor is rotated so that the spring finger enters each successive recess to hold the rotor in any of the desired rotational orientations established thereby. Examples of rotary switches using such detent mechanisms are shown in U.S. Pat. Nos. 2,813,158 (Hutt) and, 4,045,637 (Mongeau).

While the foregoing rotary switches are generally suitable for their intended purposes, they nevertheless leave something to be desired from the standpoint of simplicity of construction and assembly, ease of connection to external circuitry, and operational effectiveness.

OBJECTS OF THE INVENTION

Accordingly, it is a general object of this invention to provide a rotary switch which overcomes the disadvantages of the prior art.

It is still a further object of this invention to provide a rotary switch having a simple, yet effective detent mechanism.

It is yet another general object of this invention to provide a housing for a switch or other electrical device, such as a connector, which includes at least one insulation displacement connector and means for carrying at least one electrical wire into operative engagement with the connector.

It is yet a further object of this invention to provide a rotary switch having plural insulation displacement connectors all located within a housing and having means for effecting the electrical connection of the wires to the connectors, with the switch being simple in construction and effective in operation.

It is still a further object of this invention to provide a rotary switch having a simple, yet effective detent mechanism, and a plurality of insulation displacement connectors, all located within a housing and having means for carrying plural electrical wires into operative engagement with the connectors.

SUMMARY OF THE INVENTION

These and other objects of one aspect of the subject invention are achieved by providing an electrical switch comprising a housing formed of an electrically insulative material defining a hollow interior in which a rotatable contactor, a plurality of fixed electrically conductive contacts, and a detent mechanism are located. The fixed contacts are located adjacent the rotatable contactor. The rotatable contactor comprises a portion having plural recesses therein and is arranged to be oriented into a plurality of discrete rotational positions. The rotatable contactor also comprises electrically conductive means for electrically interconnecting selected ones of the fixed contacts depending on the rotational position of the contactor. The detent means serves to hold the contactor in any one of the discrete rotational positions and comprises a generally planar, frame-like member located in a recess in the housing. The generally planar, frame-like member is formed of a resilient material and includes an opposed pair of elongated arms extending generally parallel to each other and interconnected adjacent their respective ends by respective cantilever arms. The cantilever arms each have portions extending at an angle to the elongated arms and form a cam surface adjacent their point of intersection. Each cam surface is adapted to engage a respective recess portion of the rotatable contactor to establish the discrete rotational positions thereof and to hold the contactor against accidental displacement. The cantilever arms are enabled to flex slightly when the shaft is rotated by the application of a rotary force exceeding a predetermined minimum thereto so that the contactor can be moved to another discrete rotational position.

Various of the foregoing objects as well as other objects of this invention are also achieved by providing an electrical device comprising a housing defining a hollow interior in which a plurality of electrically conductive, insulation displacement connectors are located. The connectors enable the device to be readily electrically connected to external circuit means, via plural electrical wires having insulation thereon. Each of the connectors comprise a pair of tines spaced from each other by a distance generally corresponding to the diameter of the electrical wire to be connected thereto and having cutting edges to pierce the insulation on the wire. The housing includes pusher means and access means. The access means comprise at least one opening to enable the wires to be inserted into the housing and over the insulation displacement connectors. The pusher means is arranged to be temporarily supported in a storage position on the housing and over the opening by break-away support means. The pusher means is arranged to be displaced by a force provided thereto to cause the support means to break away from the housing, whereupon the pusher means moves towards said insulation displacement connectors to carry the wires into the tines to an operative position wherein the insulation on the wires is pierced and electrical continuity is established between the wire conductors and the connectors.

This invention will be readily appreciated as the same becomes better understood by reference to the following detailed description when considered in connection with the accompanying drawings wherein:

BRIEF DESCRIPTION OF THE DRAWINGS

FIG. 2 is a sectional view taken along line 2—2 of FIG. 1;

FIG. 5 is a sectional view taken along line 5—5 of FIG. 3.

DETAILED DESCRIPTION OF THE PREFERRED EMBODIMENT

Figure 1:
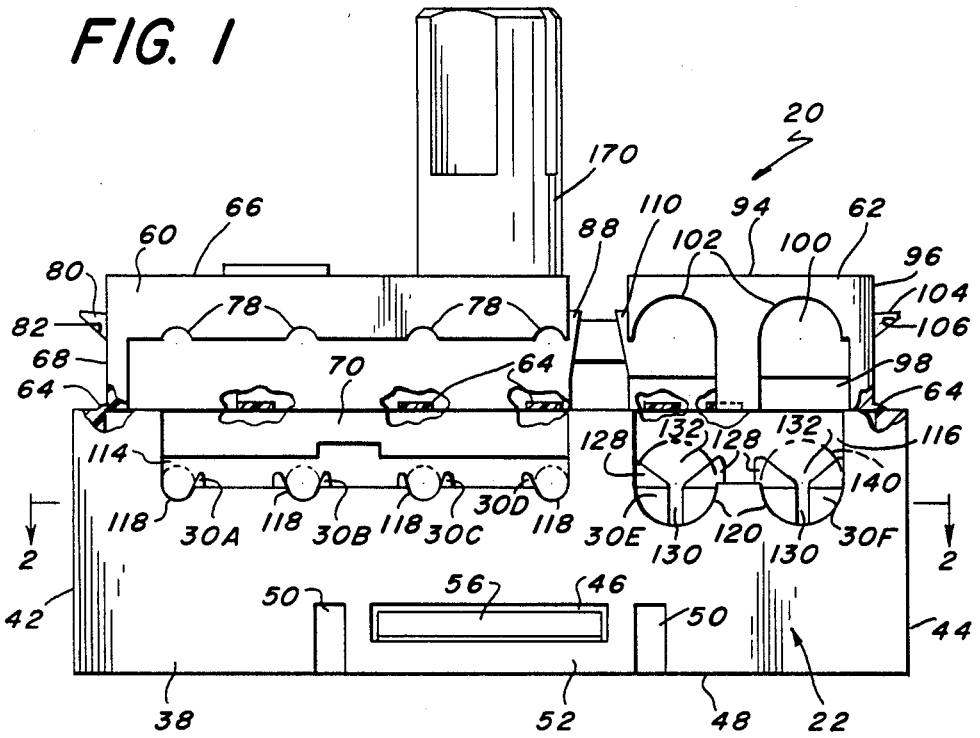
FIG. 1 is a front elevational view, partially in section, of a switch constructed in accordance with the various aspects of the subject invention.

Referring now in greater detail to the various figures of the drawing wherein like reference characters refer to like parts, there is shown in FIG. 1 a rotary switch 20 constructed in accordance with the subject invention. The switch 20 may be used to control the operation of any type of device, such as a multispeed fan. In the embodiment shown herein, the switch 20 establishes three "on"0 settings, one for each of three different fan speeds, and one "off" setting, whereupon the fan is off. Thus, each "on" setting connects different contacts of the switch together, while the "off" setting isolates the contacts from one another. It must be pointed out at this juncture that the switch 20 can be used with any electrical device and can be configured and arranged to establish any number of discrete connections.

As clearly seen in FIGS. 2 and 3, the switch 20 basically comprises a housing 22 in which is located a rotary contactor assembly 24 (to be described later), plural stationary contacts 26 (to be described later), a detent mechanism 28 (to be described later), and plural insulation displacement connectors 30 (to be described later). The housing is formed, e.g., molded, of an electrically insulative material, such as glass reinforced nylon, and consists of two components, namely, a body portion 32 and a base plate 34.

The body portion 32 is a hollow member having a top wall 36, a front wall 38, a rear wall 40, and a pair of side walls 42 and 44. The front wall and rear wall each include an elongated locking slot 46 located at approximately the middle of each wall and closely adjacent the wall's free edge 48. Each slot extends parallel to the wall's free edge. The locking slots cooperate with fingers, to be described later, on the base plate 34 to secure the base plate to the body portion. On either side of each locking slot 46 is a recess 50. The recesses 50 form a tab 52 in which the locking slot 46 is located. The side walls 42 and 44 of the body portion 32 also include locking slots 54 for connection to fingers on the base plate. Each slot 54 is similar to slot 46 described earlier and is located within a tab (not shown) similar to tab 52.

The base plate 34 basically comprises a generally planar member of rectangular profile and is arranged to close the interior of the body portion 36 when it is secured to it. To that end, the base plate 34 fits within the boundary defined by the free edge of the front, rear and side walls of the body portion. In order to secure the base plate to the body portion, the base plate includes the heretofore mentioned locking fingers. Those fingers are identified by the reference numeral 56 and project outward from the perimeter of the base plate. Each finger 56 is adapted to be snap fit within a respective locking slot in the walls of the body portion. Thus, as can be seen each finger includes a downwardly sloping cam surface 58. When the base plate 34 is inserted into the interior of the body portion 32 the sloped cam surfaces 58 of the projecting fingers engage the free edge 48 of the tabs 52, causing those tabs to flex slightly outward. Each of the projecting fingers 56 is slightly undercut on its underneath surface. Thus, the insertion of the base plate 34 into the hollow interior of the housing 32 causes the tabs and fingers to engage each other, whereupon the fingers snap into the locking slots 46 and 54. This action secures the base plate to the body portion as shown in FIGS. 3 and 4.

As will certainly be appreciated by those skilled in the art, during the assembly of the switch 20 the base plate 34 is not secured to the body portion 32 until the interior components are mounted within the housing.

As can be seen clearly in FIG. 1 the top wall 36 of the body portion 32 includes a pair of pusher members or blocks 60 and 62. The blocks are normally disposed side-by-side in a "storage" position over respective openings in the top wall of the housing and contiguous with the front wall 38. The blocks 60 and 62 are held in the storage position by plural break-away bridging members or struts 64. When a downward force is applied to each block (as will be described later), it causes the bridging member 64 to break, so that each block is forced downward into its associated underlying opening to an "operative" position. That position will be described later, suffice it for now to say that the blocks are arranged to carry plural electrical wires (which connect the switch to the electric device, e.g., fan, to be controlled thereby) into electrical engagement with the insulation displacement connectors 30 located within the housing as the blocks move into the operative position. When the blocks are in the operative position they lock in place. At that point, the wires are in intimate electrical engagement with the insulation displacement connectors. Further still, when the blocks are in the operative position, they seal the housing's openings from the ambient surrounding.

Figure 4:
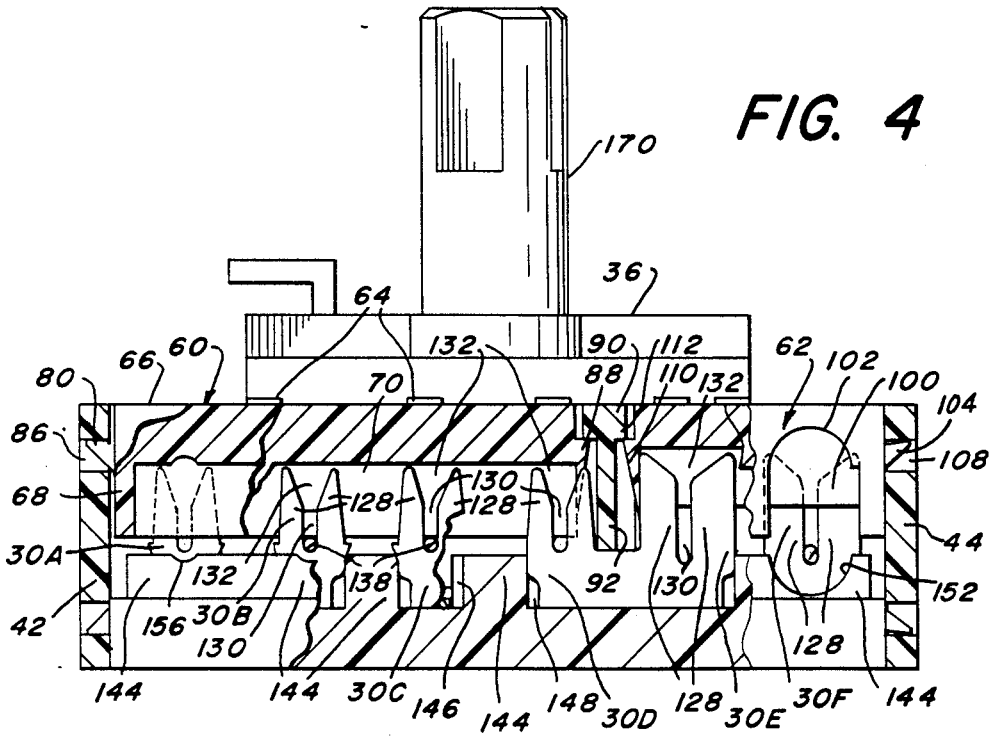
FIG. 4 is a sectional view taken along line 4—4 of FIG. 3.
Figure 3:
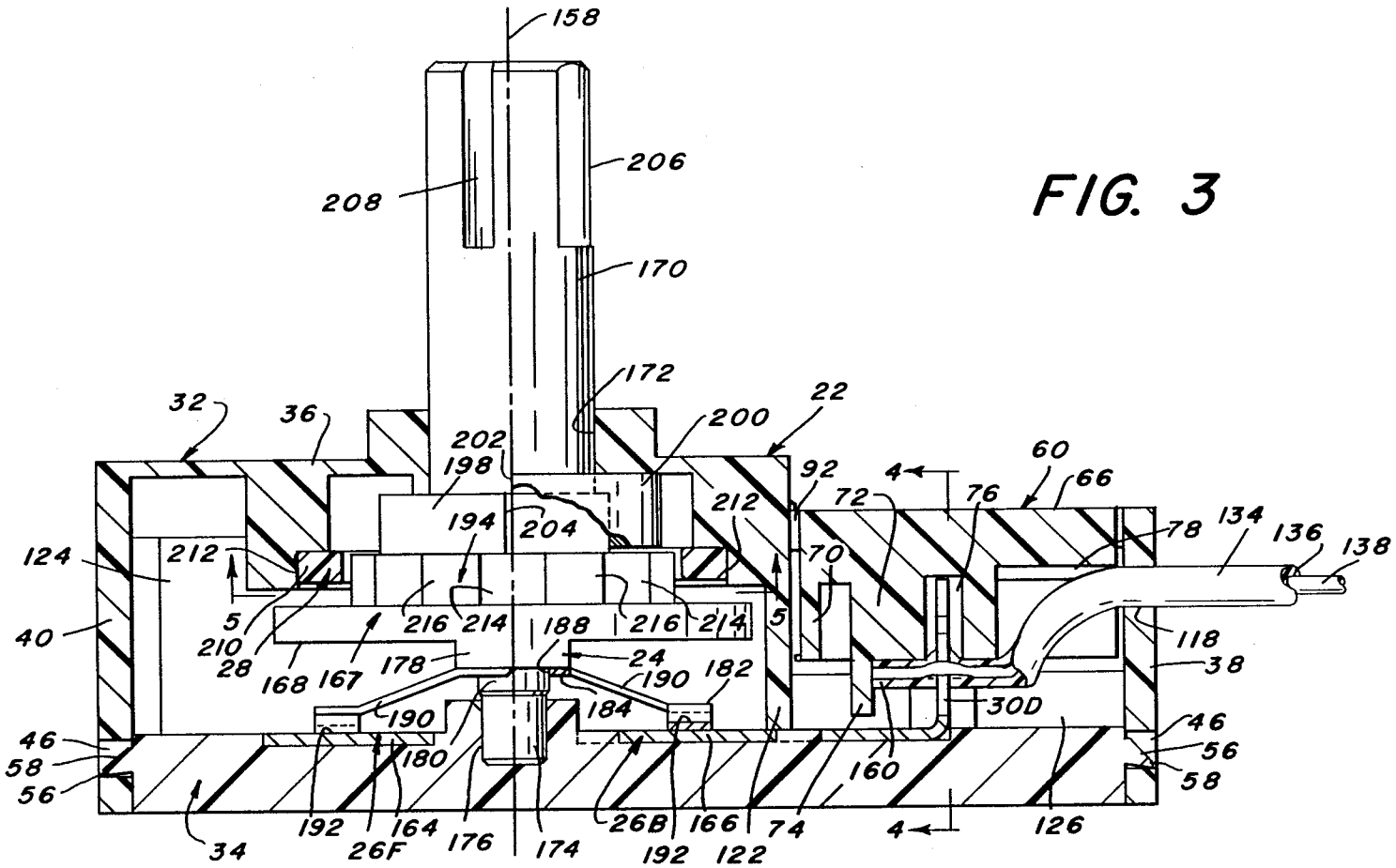
FIG. 3 is a sectional view taken along line 3—3 of FIG. 2.

As can be seen in FIGS. 1, 3 and 4 the block 60 is larger than block 62 and includes a top wall 66, a side wall 68 and a rear wall 70. Projecting downward from the underside of the top wall 66 parallel to the rear wall is an intermediate wall 72 (FIG. 3) having a stop edge 74 projecting downward therefrom. The stop edge serves to position four of the wires inserted into the housing for connection to four of the switch's insulation displacement connectors. A recess 76 extends along the intermediate wall 72 adjacent the front thereof. This recess serves to receive the tines of four of the insulation displacement connectors when block 60 is in the operative position. The underside of the block's top wall 66 also includes plural, elongated, semi-circular recesses 78 extending from the front edge of the block 60 to the intermediate wall 72. These recesses serve to receive and align the four wires to be connected to the insulation displacement connectors located under block 60.

In order to enable the block 60 to be locked in the operative position, it includes a locking finger 80, similar to finger 56 described heretofore. The finger 80 projects outward from the side wall 68 of the block 60.

However, the cam surface 82 of the finger 80 is on the underside thereof. The finger 80 cooperates with the locking slot 86 (FIG. 4) formed in a tab, like tab 52 and which is located in the top of the side wall 42 adjacent the front wall 38 when the block 60 is moved into the operative position. Another locking finger 88 is provided on the end of the intermediate wall 72 opposite to the finger 80. The finger 88 is arranged to engage the underside of a ledge 90 on an internal wall 92 of the housing body portion 32 when the block 60 is in the operative position to further ensure that the block is locked in place.

The smaller block 62 is in many ways similar to block 60. Thus, as can be seen, block 62 includes a top wall 94, a side wall 96, and a rear wall 98. Projecting downward from the underside of the top wall 94 parallel to the rear wall is an intermediate wall 100. A pair of recesses (not shown) are axially aligned and extend along the intermediate wall. These recesses serve to receive the tines of two other insulation displacement connectors when block 62 is in the operative position. The underside of the top wall 94 includes a pair of enlarged diameter recesses 102. The recesses extend from the front edge of the block 62 to the intermediate wall 100. The recesses are provided to receive and align two other, and larger diameter, wires to be connected to the insulation displacement connectors located under block 62.

In order to lock the block 62 in the operative position, it includes a locking finger 104, similar to finger 80 described heretofore, projecting outward from the block's side wall 96. The cam surface 106 of the finger 104 projects downward and cooperates with an elongated slot 108 in a tab, like tab 52, located in the side wall 44 at the top edge thereof and adjacent the housing's front wall 38 when the block 62 is in the operative position. Another locking finger 110, similar to finger 88, is located on the other end of the intermediate wall 100 disposed opposite to finger 104. The locking finger 110 engages the underside of ledge 112 on the internal wall 92 of the housing portion 32 in the similar manner as finger 88 engages the ledge 90.

The top edge of the front wall 38 includes a generally rectangular recess 114 extending substantially the width of block 60 and a second rectangular recess 116 extending substantially the width of the block 62. The lower edge of the recess 114 includes plural semi-circular recesses 118 aligned with the semi-circular recesses 78 in the block 60. In a similar manner the lower edge of rectangular recess 116 includes a pair of enlarged semi-circular recesses 120, each aligned with a respective semi-circular recess 102 in the block 62. When the block 60 is in the operative position, its semi-circular recesses 78 cooperate with the semi-circular recesses 118 in the housing's body portion to form circular passages through which the four smaller diameter electrical wires to be connected to the insulation displacement connectors pass. The diameter of each circular passage is dimensioned to tightly encircle the insulation on the wire to prevent the ingress of dirt or other debris therethrough. The recesses 102 in the block 64 cooperate with the recesses 120 in the housing's body portion in the same manner when the block 62 is in the operative position to provide passages through which the two larger diameter, insulated wires pass.

As shown in FIGS. 2 and 4, the heretofore described intermediate wall 92 of the housing 32 extends perpendicularly from the inside surface of the housing's front wall 38 to a transversely extending intermediate wall 122. The wall 122 serves to hold the fixed contacts in place on the base plate and also divides the interior of the housing into two chambers, 124 and 126. The chamber 124 is the larger of the two chambers and holds the rotatable contactor assembly 24, the stationary contacts 26, and the detent mechanism 28 therein. The chamber 126 holds the insulation displacement connectors 30.

In accordance with the embodiment disclosed herein, the insulation displacement connectors 30 are in two groups, one group, comprising connectors 30A, 30B, 30C and 30D, is arranged to be connected to the four, smaller diameter, electrically insulated wires (to be described later). The other group of insulation displacement connectors, comprising connectors 30E and 30F, is arranged to be connected to the two larger diameter electrically insulated wires (also to be described later). The wall 92 divides the interior of the connector chamber 126 into two compartments, one compartment holding the four insulation displacement connectors 30A, 30B, 30C and 30D and the other compartment holding the two insulation displacement connectors 30E and 30F.

All of the insulation displacement connectors 30A, 30B, 30C, 30D, 30E and 30F are of the same general construction. Thus, each includes a pair of tines 128 having sharp edges which are spaced apart from each other so as to form a wire receiving-recess 130 therebetween. The entrance to the recess is in the form of a V-shaped mouth 132 to guide the wire into the recess. The width of the recess 130 is approximately the same as the outside diameter of the electrical conductor of the wire to be connected thereto so that when the wire is forced into the recess, the sharp edges of the tines forming the recess cut through the insulation on the wire to engage the wire's conductor in good electrical continuity.

As mentioned earlier, in the embodiment of the switch 20 shown herein, the wires to be connected to insulation displacement connectors 30A, 30B, 30C and 30D are smaller diameter wires 134 having a relatively thin layer of insulation 136 surrounding an electrically conductive central conductor 138. The wires to be connected to connectors 30E and 30F are of larger diameter, e.g., have thicker insulation thereon, and are not shown except for their central conductor 140 (FIG. 2).

In order to hold the tines of the insulation displacement connectors 30 upward, that is perpendicular to the bottom plate 34, the bottom plate includes a ridge 144 projecting upward slightly therefrom and extending transversely across the bottom plate. The ridge includes a plurality of generally T-shaped slots 146, 148 and 150. Each T-slot is arranged to hold a portion of the insulation displacement connector contiguous with the tines vertically, that is projecting upward normally from the inner surface of the bottom plate 34, and with the two tines making up each connector exposed. The slots 146 are located so that the recess 130 in each of the insulation displacement connectors 30A–30C is generally aligned with the respective recesses 118 in the front wall 38 of the body portion 32 of the housing. The slot 148 is of a greater width and serves to hold the insulation displacement connectors 30D and 30E therein, and with those connectors aligned with recesses 118 and 120, respectively, in the front wall 38 of the body of the housing. The slot 150 is of intermediate width and is aligned with the rightmost recess 120 in the front wall of the housing. Thus, when the four wires 134 are disposed in the recesses 118 with their respective free ends extending into the chamber 126, the downward movement of the pusher block 60 will carry those wires into the respective recesses between the tines of the connectors 30A, 30B, 30C and 30D to effect the electrical connection of those wires to those connectors. Similarly, when the two larger diameter wires are disposed in the two recesses 120 with their free ends extending into chamber 126, the downward movement of block 62 will carry those wires into the recesses between the tines of connectors 30E and 30F to effect the electrical connection of those wires to those connectors.

The transversely extending ridge 144 on the bottom plate 34 also includes a hemispherical shaped recess 152 aligned with the slot 150 to accommodate the insulation of the large diameter wire to be connected to connector 30F. A similar shaped recess 154 is provided in the right portion of the enlarged width slot 148 to accommodate the insulation of the other large diameter wire to be connected to connector 30E. A smaller diameter arcuate recess 156 is provided in the ridge 144 in the left portion of the enlarged width slot 148 and other similar recesses 156 are aligned with each of the slots 146 to accommodate the insulation 136 of the four small diameter wires 134 to be connected to connectors 30D, 30C, 30B and 30A, respectively.

In the embodiment disclosed herein, each of the insulation displacement connectors 30A, 30B, 30C and 30F forms one end of a respective stationary contact 26A, 26B, 26C and 26F. As will be described later, when the switch is in any of the three "on" positions, the contact 26F is electrically interconnected to a respective one of the contacts 26A, 26B or 26C, to electrically interconnect the wires connected to the associated insulation displacement connectors. The two connectors 30D and 30E are connected to each other so that the wires connected thereto are always connected to each other. Each of the insulation displacement connectors is formed of a conventional electrically conductive material.

The electrical interconnection of the wires to their respective insulation displacement connectors will now be described. When the switch is in the position like shown in FIG. 1, that is with the pusher blocks 60 and 62 in the storage position, the four smaller diameter wires 134 are introduced through the opening 114 into the interior of the housing. Each wire 134 is positioned so that it is located within a respective recess 118 in the front wall of the housing. The free end 160 of each of the wires 134 is extended sufficiently into the housing so that it abuts the stop 74 of the intermediate wall 72. This action prevents the over-insertion of the wires into the interior of the housing. The large diameter wires are inserted through opening 116 into the interior of the housing, with the wires located within recesses 120 in the same manner as described above.

The application of the downward force to the top wall 66 of block 60 causes its break-away bridging supports 64 to snap, whereupon the pusher block 60 slides downward into the interior of chamber 126. The downward movement of the pusher block 60 causes the intermediate wall 72 to carry the wires 134 into the respective insulation displacement connectors. Thus, the free end portion 160 of each wire enters into the mouth portion 132 of the associated insulation displacement connector. With the continued downward movement of the block 60, the knife edges of the two tines forming each connector slice in through the insulation 136 on the wire. The recess 76 in the intermediate wall 72 receives the top ends of the tines to enable the block to be pushed fully downward to the operative position. In the operative position the conductors 138 of the wires are engaged by the knife edges of the respective tines to form a good electrical connection therebetween. As seen in FIG. 3 the ends of the wires 134 are bent or offset by the intermediate wall portion 72 from their point of entrance into the housing. This has the effect of providing some strain relief to the wires and also thwarts any pullout of the wires from the housing. When the block 60 is in the operative position its projecting fingers 80 and 88 lock the block in place as shown in FIG. 4 to hold the wires in good electrical contact with their respective insulation displacement connectors while also sealing off the interior of the compartment 126 from the ambient atmosphere.

The connection of two large diameter wires to the insulation displacement connectors 30E and 30F is accomplished in a similar manner as just described by the application of a downward force onto pusher block 62.

As can be seen in FIGS. 2 and 3, the stationary contacts 26A, 26B, 26C and 26F are mounted flush with the inner surface of the base plate 34 and located adjacent the rotary contactor assembly. To that end portions of the fixed contacts are held in position on the top surface of the base plate via the use of small nibs 162 extending upward from the top surface of the bottom plate and through respective openings in the stationary contacts 26. In addition, the ends of the stationary contacts 26A, 26B, 26C and 26D are held in position adjacent the rotor by a raised positioning surface (not shown) on the bottom plate.

As mentioned earlier, the fixed contacts are arranged so that any selected one of contacts 26A, 26B, or 26C can be electrically interconnected by a moveable contactor (to be described later) on the rotary contactor assembly 24 to the fixed contact 26F when the rotor is in any one of three discrete rotational "on" positions, and to isolate those three contacts from contact 26F when the rotary contactor is in a fourth or "off" position. Thus, as can be seen in FIG. 2, the fixed contacts 26A, 26B, and 26C each includes an end portion 164 located in a generally semicircular array at a central position within the chamber 124 so that each contact can be electrically engaged by the contactor of rotary contactor assembly 24. The fixed contact 26F includes an enlarged end portion 166 disposed opposite the ends 164 of the contacts 26A, 26B and 26C to enable it to also be electrically engaged by the contactor of the rotary contactor assembly.

The rotatable contactor assembly is best seen in FIG. 3 and includes the heretofore mentioned movable contactor. That contactor is an electrically conductive bridging member or contact shoe 182. The rotatable contactor assembly 24 also includes a rotor 167 adapted to rotate about axis 158. Thus, the rotor includes a shaft 170 extending along the axis and through a circular opening 172 in the top wall 36 of the housing body 32. The lower end of the rotor 167 includes a flanged disk 168. Projecting downward axially from the flanged disk is a hub 174 which extends into a circular opening 176 in the base plate 34. With the rotor 167 so mounted it is enabled to rotate about the vertical axis 158 by twisting of the shaft 170 in either clockwise or counterclockwise direction. Extending diametrically across the underside of the disk 168 is a raised contact support surface 178. Projecting downward from that surface are a pair of circular projections 180, with one projection on one side of the hub 174 and the other projection on the other side of the hub. The projections 180 serve as the means for mounting the electrically conductive contact shoe 182 on the contact support surface 178.

The shoe 182 is clearly seen in FIG. 2 and is a ring-like member formed of an electrically conductive, resilient metal, e.g., copper, and includes a diagonally extending central mounting portion 184. The portion 184 is planar and includes three mounting holes 186 therein. The two outermost holes are arranged to receive the rotor's projections 180, while the central hole 188 receives the rotor's hub 174. The circular peripheral edge portion 190 of the contact shoe 182 is bent downward at an angle to central portion 184 (see FIG. 3) on both sides thereof to form a pair of contact engaging surfaces. In particular, the lowermost portion of each of the angled portions of the contact shoe is in the form of an arcuate engaging surface 192. One of the engaging surfaces 192 is adapted to electrically engage any of the adjacent portions 164 of the fixed contacts 26A, 26B and 26C while the diametrically opposed engaging surface 192 electrically engages the adjacent portion 166 of the fixed contact 26F when the switch is in one of the three "on" positions. When the switch is in the "off" position, the two engaging surfaces 192 do not engage any portions of the fixed contacts.

The detent mechanism 28 is arranged to hold the rotatable contactor 24 at one of the four discrete, desired rotational (detent) positions. The details of the detent mechanism can best be appreciated by reference to FIGS. 2, 3 and 5. Thus, as can be seen therein, the detent mechanism 28 basically comprises a frame-like member or plate 210 which is located and held within a retaining recess 212 on the underside of the housing's top wall 36. The detent plate is arranged to cooperate with cammed portions of the rotor 167 to establish the four detent positions. Thus, the rotor 167 includes a circular cam surface 194 (FIGS. 3 and 5) disposed about axis 158 and located above the flanged disk 168. The periphery of the circular cam surface 194 includes a plurality of recesses or notches 196 equidistantly spaced thereabout. Thus, the cam surface 194 is in the form of plural cam lobes disposed between respective notches. These alternating lobes and notches cooperate with cam surfaces forming a portion of the detent plate 210, to be described later, to hold the rotor 167 in any of the rotational positions.

The detent plate or frame 210 is a generally planar member including an opposed pair of elongated arms 220 extending generally parallel to each other and interconnected adjacent their respective ends by cantilever arms 222. Each of the cantilever arms includes two generally linear portions 224 and 226. Each of the linear portions extends at an acute angle to its associated elongated arm 220. The point at which the two portions 224 and 226 of each of the cantilever arms 222 merge is in the form of a wedge-shaped or tapering cam surface 228. The area bounded by the arms 220 and 222 of the detent plate forms a space in which the cam surface portion 194 of the rotor 167 is located. As can be seen, the outside diameter of the cam surface portion 194 is less than the spacing between the elongated arms 220 but is slightly greater than the spacing between the cam surfaces 228 of the two opposed cantilever sections 222. Thus, when the rotor is located as just described the tapering cam surface 228 of one of the detent plate's cantilever arms is located within one notch 196 of the rotor while the opposed tapering surface of the other cantilever arm is disposed within a diametrically opposed notch 196. This action holds the rotor in any of the detent positions.

As will be described later, the detent plate is formed of a resilient material. Thus, the cantilever arms 222 of the detent plate are enabled to bend or deform upon the rotation of the rotor about axis 158 so that the two cam surfaces 228 of the cantilever arms can ride up the surfaces forming the notches 196 to engage the immediately adjacent lobes of the surface 194. Continued rotation of the rotor will bring the next adjacent notches 196 into alignment with the tapering cam surfaces 228 of the cantilever arms, whereupon those surfaces will enter those notches to apply a force resisting further rotation of the rotor. The manner in which the cantilever arms flex and the elongated arms move during the rotation of the rotor from one detent position to another will be described hereinafter.

The detent plate is preferably formed of a tough, resilient insulation material, such as nylon, or other formable material having the elastic property of being able to immediately recover its initially formed durable shape when it is relieved of a deforming force or pressure causing it to be temporarily deformed or flexed. In accordance with the preferred embodiment of the invention, the rotor is also formed of a similar material so that its lobed cam surface which engages the detent plate can slide relative thereto upon the application of a rotary force to the rotor shaft.

As mentioned earlier the detent plate is held within a recess 212 of the housing body portion 32. That recess is defined by an elongated pair of short height side walls 230 extending transversely across the underside of the top wall of the housing and interconnected at their respective ends by an opposed pair of longitudinally extending end walls 232, also of short height. The spacing between the inside surfaces of the side walls 230 is the same or just slightly larger than the spacing between the outer surface of one elongated arm 220 of the detent plate and the outer surface of the other opposed elongated arm 220 of the plate. The length of each of the plate's arms 220 is less than the spacing between the inside surfaces of the two end walls 232. Accordingly, the two side walls 230 constrain the elongated arms 220 from flexing outward but enable those arms to slide therealong when the cantilever arms 220 are flexed or deformed by their tapered cam surfaces 228 sliding up the notches 196 and onto the circular periphery 194 (the lobes) of the rotor as occurs during the rotation of the rotor from one detent position to the next. This flexure/sliding action is as follows:

Assuming that the rotor is rotated in the clockwise direction as shown by the arrow in FIG. 5, the tapered cam surface 228 of the rightmost cantilever arm 222 begins to ride up the trailing surface of the notch 216. At the same time the cam surface 228 of the other cantilever arm rides up the leading surface of the opposed notch 216. This action causes the two cantilever arms 222 to flex so that the elongated arm 220 shown in the upper portion of FIG. 5 slides along side wall 230 to the left while the opposed elongated arm 220 of the detent plate slides along its associated side wall 230 to the right. This flexure/sliding action enables the rotor to be rotated with a modest force to the next detent position, that is the position wherein the next succeeding notches are aligned with the cam surfaces 228 of the opposed cantilever arms. Once that occurs the two cantilever arms move back to their normal and unflexed position, whereupon the detent plate is in the unstressed position shown in FIG. 5. As should, of course, be appreciated by those skilled in the art, rotation of the rotor in the counterclockwise direction causes the two cantilever arms 222 to flex in a manner so that the two elongated arms 220 slide along their respective walls in the opposite directions as previously described. In either case the detent plate cooperates with the cam surfaces to ensure that the rotor is held at desired detent position against accidental rotation, while enabling the rotor to be rotated to another detent position without requiring the application of a high or excessive rotational force.

In order to prevent the two cantilever arms from flexing out of the plane of the detent plate, which could adversely affect switch operation, the bottom of the recess 212 is in the form of a pair of base walls 214. Each base wall 214 is adapted to support virtually the entire associated cantilever arm 222 thereon, with only the tapering cam surface 228 being unsupported to enable that portion to enter freely into an aligned notch 196 of the rotor.

In order to prevent the rotor from continuously rotating about axis 158, stop means are provided on the housing and on the rotor. The stop means basically comprises a circular projection 198 extending less than 180° about the periphery of the rotor's shaft 170. A fixed arcuate wall 200 projects downward from the inner surface of the housing top wall 36 concentric with the opening 172 and also extends for less than 180° about the opening. The ends of the fixed arcuate wall portion 200 are denoted by the reference numeral 202 (only one of which can be seen) and are adapted to engage respective ends 204 of the rotor's arcuate wall 198 to establish an angular range through which the rotor can be rotated into any of the four detent positions.

As can be clearly seen in FIGS. 1, 3 and 4 the free end of the shaft 170 includes flatted surfaces 206 and a central slot 208 to enable a knob (not shown) or other element (not shown) to be mounted on the free end of the shaft for effecting its rotation.

It should be pointed out at this juncture that the specific shape of the switch housing, the number of insulation displacement connectors, the size and construction of such connectors, etc., the number of pusher blocks, can be changed as desired, provide any suitable switch. Moreover the switch need not have four detent positions as shown and described heretofore but may have less or more, depending upon the desired application.

Without further elaboration the foregoing will so fully illustrate our invention that others may, by applying current or future knowledge, adopt the same for use under various conditions of service.

What is claimed is:

1. An electrical switch comprising a housing defining a hollow interior in which a contactor, a plurality of fixed electrically conductive contacts, rotatable means and detent means are located, said contacts being located adjacent said contactor, said contactor being coupled to said rotatable means and arranged to be oriented in a plurality of discrete rotational positions, said rotatable means comprising a portion having plural recesses therein, said contactor comprising electrically conductive means for electrically interconnecting selected ones of said fixed contacts depending upon the discrete rotational position of said rotatable means, said detent means serving to hold said rotatable means in any one of said discrete rotational positions and being located in a first recess in said housing, said detent means comprising a thin, frame-like member formed of a resilient material and including an opposed pair of elongated arms having outside edges and extending generally parallel to each other and interconnected adjacent their respective ends by cantilever arm portions, each of said cantilever arm portions forming a cam surface, said first recess including a pair of side walls and a pair of end walls, said end walls being disposed opposite each other and spaced apart by a first distance greater than the length of said elongated arms of said detent means, said side walls being spaced apart by a second distance corresponding to the spacing between the outside edges of said elongated arms, each of said cam surfaces selectively engaging a respective recess of said rotatable means to establish said discrete rotational positions to hold said rotatable means therein against accidental displacement, said cantilever arm portions being enabled to flex slightly and said elongated arms to move along said side walls of said first recess when said rotatable means is rotated by the application of a force exceeding a predetermined minimum thereto to facilitate the exit of said cam surfaces from said recesses so that said rotatable means can be readily moved to another discrete rotational position.

2. The rotary switch of claim 1 wherein each of said cantilever arm portions comprises a pair of cantilever arms intersecting each other and wherein said cam surface is located adjacent said point of intersection.

3. The rotary switch of claim 2 wherein said contactor is connected to said rotatable member and is rotated therewith.

4. The rotary switch of claim 1 wherein said fixed contacts are electrically interconnected to respective insulation displacement connectors to enable said switch to be readily electrically connected, via plural electrical wires, to external circuit means.

5. The rotary switch of claim 4 wherein said insulation displacement connectors each comprise a pair of tines spaced from each other by a distance corresponding to the diameter of the conductor of the electrical wire to be connected thereto and having cutting edges to pierce the insulation on said wires.

6. The rotary switch of claim 4 wherein said housing includes access means providing access to said insulation displacement connectors and pusher means disposed adjacent said access means and arranged to be moved to force at least some of said wires into their respective insulation displacement connectors.

7. The rotary switch of claim 6 wherein said insulation displacement connectors each comprise a pair of tines spaced from each other by a distance corresponding to the diameter of the conductor of the electrical wire to be connected thereto and having cutting edges to pierce the insulation on said wires.

8. The rotary switch of claim 7 wherein said detent means is formed of a plastic material.

9. The rotary switch of claim 2 wherein said cantilever arms intersect each other at an acute angle to form said cam surface, said cam surface being tapered.

10. The rotary switch of claim 6 wherein said pusher means comprises a body portion which is initially fixedly secured to said housing but which upon the application of force thereto breaks away from said housing to move said wires into connection with said insulation displacement connectors.

11. The rotary switch of claim 10 wherein said access means comprise a plurality of recesses in said housing and a corresponding plurality of recesses in said pusher body to conjointly form respective passages, one for each of said wires, each of said passages being aligned with a respective one of said insulation displacement connectors.

12. The rotary switch of claim 10 wherein said body portion includes locking means for holding said body portion in the position wherein the electrical wires are in electrical contact with said insulation displacement connectors.

13. The rotary switch of claim 7 wherein said housing includes supporting means for holding said tines in a position wherein said electrical wires may be easily secured thereto.

14. The rotary switch of claim 13 wherein said supporting means comprise respective slots for said insulation displacement connectors.

15. An electrical device comprising a housing defining a hollow interior in which at least one electrically conductive insulation displacement connector is located to enable said device to be readily electrically connected to external circuit means, via at least one electrical wire having insulation thereon, said insulation displacement connector comprising a pair of tines spaced from each other by a distance generally corresponding to the diameter of the conductor of the electrical wire to be connected thereto and having cutting edges to pierce the insulation on said wire, said housing comprising pusher means and access means, said access means comprising at least one opening to enable said wire to be inserted into said housing over said insulation displacement connector, said pusher means being temporarily supported in a storage position on said housing and over said opening by breakaway support means, said pusher means being arranged to be displaced by a force provided thereto to cause said support means to break away from said housing, whereupon said pusher means moves towards said insulation displacement connector to carry said wire into said tines to an operative position wherein the insulation thereon is pierced and electrical continuity is established between said wire and said connector.

16. The device of claim 15 wherein said device comprises a switch.

17. The switch of claim 16 wherein said pusher means and said housing cooperate when said pusher means is in said operative position to lock said pusher means in place.

18. The switch of claim 17 wherein said pusher means and said housing means effectively isolate said insulation displacement connector and the wire connected thereto from the ambient atmosphere.

19. The switch of claim 18 wherein said pusher means comprises a body and wherein said access means comprises at least one recess in said body, said recess receiving a portion of a wire therein when said pusher body is in said operative position.

20. The switch of claim 19 wherein said housing comprises at least one recess therein, said recess being adapted to receive a portion of a wire therein when said pusher body is in said operative position.

21. The switch of claim 17 wherein said pusher means comprises a body which includes at least one projection and wherein said housing includes at least one aperture into which said projection extends when said pusher means is in said operative position to thereby lock said pusher body in place.

22. The switch of claim 21 wherein said projection includes a cam surface thereon to facilitate the entry of said projection into said aperture.

23. The switch of claim 22 wherein said pusher means comprises a body and wherein said access means comprises at least one recess in said body, said recess being adapted to receive a portion of a wire therein when said pusher body is in said operative position.

24. The switch of claim 23 wherein said housing comprises at least one recess therein, said recess receiving a respective wire therein when said pusher body is in said operative position.

25. The switch of claim 16 wherein said switch includes rotatable means, a contactor coupled thereto and a plurality of fixed electrically conductive contacts located within said housing and adjacent said contactor, said rotatable member being arranged to be oriented in a plurality of discrete rotational positions by a shaft connected thereto, said contactor including electrically conductive means for electrically interconnecting selected ones of said fixed contacts depending upon the discrete rotational position of said rotatable member, and detent means to hold said rotatable means in any one of said discrete rotational positions, said detent means being located in a recess in said housing and comprising a thin, frame like member formed of a resilient material and including an opposed pair of elongated arms having outside edges and extending generally parallel to each other and interconnected adjacent their respective ends by cantilever arms, said cantilever arms having portions extending at an acute angle to said elongated arms and forming a tapering cam surface adjacent their point of intersection, said tapering cam surfaces selectively engaging diametrically opposed recessed portions of said rotatable means to establish said discrete rotational positions and hold said rotatable means therein against accidental displacement, said cantilever arms being enabled to flex slightly when said shaft is rotated by the application of a rotary force exceeding a predetermined minimum thereto so that said contactor can be moved to another discrete rotational position.

26. The switch of claim 25 wherein said detent means is formed of plastic.

27. The switch of claim 26 wherein said recess in said housing for said detent means includes a pair of side walls and a pair of end walls, and wherein said end walls are disposed opposite each other and spaced apart by a distance greater than the length of said elongated arms of said detent means and wherein said side walls are disposed parallel to each other and spaced apart by a distance corresponding to the spacing between the outside edges of said elongated arms, whereupon when said shaft is rotated said cantilever arms flex slightly and said elongated arms move along said side walls of said recess to facilitate the exit of said cam surfaces from the recesses of said contactor.

* * * * *